United States Patent [19]

Sakai et al.

[11] 3,969,045

[45] July 13, 1976

[54] DIAPHRAGM VACUUM PUMP FOR VEHICLES

[75] Inventors: Toshimitsu Sakai; Tadashi Saito, both of Toyota; Isamu Suzuki, Aichi, all of Japan

[73] Assignees: Toyota Jidosha Kogyo Kabushiki Kaisha, Toyota; Aisan Kogyo Kabushiki Kaisha, Obu, both of Japan

[22] Filed: Dec. 16, 1974

[21] Appl. No.: 533,216

[30] Foreign Application Priority Data

Dec. 28, 1973 Japan ..... 48-1957

[52] U.S. Cl. ..... 417/471; 92/85 R

[51] Int. Cl.[2] ..... F04B 39/00; F01B 11/02

[58] Field of Search ..... 92/98, 99, 85 R, 60.5, 92/130 C; 417/470, 562, 471

[56] References Cited

UNITED STATES PATENTS

| | | | |
|---|---|---|---|
| 2,185,784 | 1/1940 | Corydon et al. | 92/99 |
| 2,638,849 | 5/1953 | Budlane | 92/99 |
| 2,895,424 | 7/1959 | Tramontini et al. | 92/99 |
| 3,298,321 | 1/1967 | Reifel | 417/470 |
| 3,613,518 | 10/1971 | Prosser | 92/99 |

FOREIGN PATENTS OR APPLICATIONS

| | | | |
|---|---|---|---|
| 251,294 | 10/1960 | Australia | 92/99 |
| 427,964 | 8/1911 | France | 417/562 |
| 1,222,716 | 7/1969 | United Kingdom | 417/571 |

*Primary Examiner*—William L. Freeh

*Attorney, Agent, or Firm*—Stevens, Davis, Miller & Mosher

[57] ABSTRACT

In a diaphragm vacuum pump for vehicles, a resilient cushion material is integrally secured on the diaphragm piston within the pressure reduction chamber of the pump to minimize the volume of the pressure reduction chamber when the diaphragm piston reaches its upper dead point.

4 Claims, 1 Drawing Figure

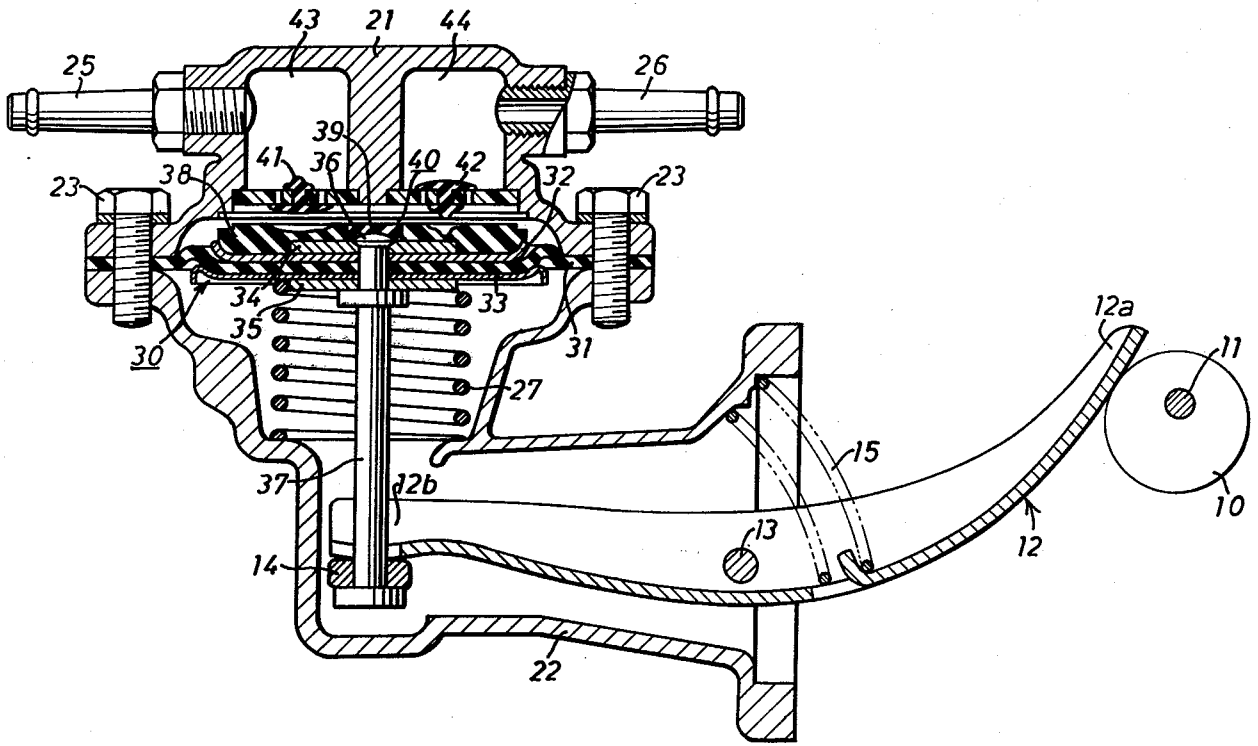
10
11
12a
12
15
13
22
14
37
12b
27
31
23
26
32
33
42
44
40
21
39
36
43
41
34
35
38
30
25
23

DIAPHRAGM VACUUM PUMP FOR VEHICLES

BACKGROUND OF THE INVENTION

The present invention relates to a vacuum pump, and more particularly to an improvement of a diaphragm vacuum pump to be driven by an engine of a vehicle to supply vacuum to pneumatically operated devices with which the vehicle is equipped.

Conventional vacuum pumps of this type are generally so constructed as to effect reciprocation of a diaphragm piston by swinging operation of a rocker arm engaged with an eccentric cam driven by the vehicle engine. With the conventional vacuum pump, a disadvantage has been experienced because of damage to the valve devices of the pump by the piston when the upper dead point of the piston is raised up by wear or defacement of the engaging faces of the cam and the rocker arm in course of the operation of the pump. Furthermore, the obtainable vacuum degree is much influenced by the volume difference within a pressure reduction chamber, the volume difference being decided by the positions of the upper and lower dead points of the diaphragm piston.

SUMMARY OF THE INVENTION

The prime object of the present invention is, therefore, to provide a diaphragm vacuum pump, wherein when a diaphragm piston reaches its upper dead point, the volume of the pressure reduction chamber is minimized to obtain a high vacuum degree.

Another object of the present invention is to provide a diaphragm vacuum pump, having the above-mentioned characteristics, wherein the valve devices provided within the pump are protected from damage even when the upper dead point of the piston is raised up due to wear or defacement of the engaging faces of the associated rocker arm and eccentric cam.

Still another object of the present invention is to provide a diaphragm vacuum pump, having the above-mentioned characteristics, and having a resilient cushion material on the upper face of the diaphragm piston, thereby to minimize the volume of the pressure reduction chamber when the diaphragm piston reaches its upper dead point and to absorb touching or shock pressure when the diaphragm piston touches the valve devices and the inner wall of a pump housing due to the upward displacement of the upper dead point of the piston.

BRIEF DESCRIPTION OF THE DRAWING

The above mentioned and further objects and features of the present invention will become clearer from the following description in reference with the accompanying drawing, which depicts a preferred embodiment of a diaphragm vacuum pump in accordance with the present invention.

DESCRIPTION OF THE PREFERRED EMBODIMENT

Referring now to the drawing, the construction of a diaphragm vacuum pump in accordance with the present invention is described hereinafter in detail. An eccentric cam 10 is secured on a pump drive shaft 11 driven by a prime engine (not shown) of a vehicle. A rocker arm 12 is journalled by way of a pivot pin 13 on the inner wall of a lower housing 22. The bottom face of the outer end 12*a* of the rocker arm 12 engages the cam face of the eccentric cam 10. The inner end 12*b* of the rocker arm 12 is connected through a washer 14 to the lower end of an operation rod 37. The rocker arm 12 is normally biased clockwisely in the FIGURE by a compression spring 15 interposed between the inner wall of the lower housing 22 and a portion of the rocker arm 12.

A diaphragm piston assembly 30 comprises a disc-shaped diaphragm 31 whose rim is air-tightly clamped by way of bolts 23 between the engaging portions of an upper housing 21 and the lower housing 22 and the operation rod 37, the upper end of which is firmly secured on the central portion of the diaphragm 31 by a caulker 36 through upper and lower discs 32, 33 and washers 34, 35. The annular rims of the discs 32, 33 are curved upwardly and downwardly, respectively. Integrally adhered on the upper face of the upper disc 32 is a cushion disc 38 made of such elastic material as synthetic rubber in predetermined varying thickness with a cross-section corresponding with the bottom shapes of check valves 41, 42 and the inner wall of the upper housing 21 surrounding the check valves 41 and 42. This cushion disc 38 covers the caulker 36 of the operation rod 37 and the upstanding rim of the upper disc 32 and the central hole of the cushion disk 38 is covered with a filling 39 made of synthetic rubber. Moreover, the upper disk 32 may be provided thereon with a plurality of claws extending radially and inwardly and the cushion disk 38 may be integrally molded with or baked on the upper disk 32 with the claws.

Above the diaphragm piston assembly 30, is formed a pressure reduction chamber 40 which communicates with a suction chamber 43 and a discharge chamber 44 respectively through the suction check valve 41 and the discharge check valve 42. The suction chamber 43 is provided with an inlet port 25 connected with a pneumatically operated device such as the vacuum cylinder of a brake booster (not shown) and the discharge chamber 44 is provided with an outlet or exhaust port 26. A coil spring 27 surrounding the operation rod 37 is interposed between the bottom face of the lower disc 33 and the inner wall of the lower housing 22 thereby to normally bias the diaphragm piston assembly 30 upwardly in the FIGURE.

In operation of the vacuum pump with the above-mentioned construction, the rotation of the eccentric cam 10 driven by a vehicle engine causes the swinging movement of the rocker arm 12 about a fulcrum at the pivot pin 13 by the engagement of the cam 10 with the outer end of the rocker arm 12 and the biasing forces of the compression spring 15 and the coil spring 27. The swinging movements of the rocker arm 12 reciprocate the diaphragm piston 30 by way of the operation rod 37. During the reciprocation of the diaphragm piston assembly 30, the resilient force of the coil spring 27 keeps constant engagement of the lower end of the operation rod 37 with the inner end 12*b* of the rocker arm 12 by way of the washer 14.

Thus, during the downward movement of the diaphragm piston assembly 30, the suction check valve 41 is opened and the discharge check valve 42 is closed, thereby to suck the air from the pneumatically operated device into the pressure reduction chamber 40 through the inlet port 25, the suction chamber 43 and the suction check valve 41. Meanwhile, during the upward movement of the diaphragm piston assembly 30, the suction check valve 41 and the discharge check valve 42 are conditioned respectively to their closed and open states, thereby to discharge the sucked air externally from the pressure reduction chamber 40 by way of the discharge check valve 42, the discharge chamber 44 and the outlet port 26. This produces vacuum pressure within the pressure reduction chamber 40.

When the diaphragm piston assembly 30 reaches its upper dead point in its reciprocation, the volume of the pressure reduction chamber 40 becomes smaller than that of a conventional vacuum pump due to the provision of the cushion disc 38 on the upper disc 32. This very much increases the vacuum efficiency within the pressure reduction chamber 40.

In course of operation for long hours, wear or defacement of the engaging faces of the cam 10, the outer and inner ends 12*a* and 12 *b* of the rocker arm 12 and the washer 14 raises the upper dead point of the diaphragm piston assembly 30. As a result, the cushion disc 38 will touch the bottoms of the check valves 41 and 42 and the inner wall of the upper housing 21 surrounding the valves 41 and 42. The resiliency of the cushion disc 38 will, however, protect the valves 41 and 42.

As it is now clear, the diaphragm vacuum pump in accordance with the present invention is characterized in that the cushion disc 38 is integrally provided on the upper side of the diaphragm piston assembly 30, whereby the volume of the pressure reduction chamber 40 becomes much smaller upon the arrival of the diaphragm piston assembly 30 at its upper dead point and the resiliency of the cushion disc 38 absorbs any touching pressure against the valves 41 and 42 and the inner wall of the upper housing 21 in case the upper dead point of the diaphragm piston 30 is raised up. Consequently, a higher vacuum degree becomes obtainable and the life of the vacuum pump is prolonged.

Although a certain specific embodiment of the present invention has been shown and described, it is obvious that many modifications and variations thereof are possible in light of these teachings. It is to be understood therefore that within the scope of the appended claims, the invention may be practiced otherwise than as specifically described herein.

What is claimed is:

1. In a diaphragm vacuum pump for a vehicle, comprising a pump housing mounted on a body portion of the vehicle and including thereon an inlet port connected to a pneumatically operated device and an exhaust port connected to the atmosphere; a diaphragm piston assembly hermetically assembled within said housing for forming a pressure reduction chamber at one side thereof, said chamber being connected respectively with said inlet and exhaust ports; valve means assembled within said chamber and including a suction valve to suck the air from said pneumatically operated device into said chamber through said inlet port and an exhaust valve to discharge the sucked air externally through said exhaust port; an operation rod for reciprocating said diaphragm piston assembly for subsequently producing vacuum in said pressure reduction chamber; a drive mechanism driven by the prime engine of the vehicle for operating said operation rod; and a resilient means for biasing said diaphragm piston assembly to its upper dead point against the operation torque from said drive mechanism by way of said operating rod, the improvement wherein a resilient cushion material is integrally secured on said diaphragm piston assembly within said pressure reduction chamber and between said diaphragm piston assembly and said valve means to constantly minimize the volume of said chamber when said diaphragm piston assembly reaches its upper dead point and to absorb touching pressure against said valve means, and said resilient cushion material is an elastic synthetic resin member of predetermined thickness with a cross-section corresponding with the shape of the inner wall facing said diaphragm piston assembly within said pressure reduction chamber.

2. A diaphragm vacuum pump as claimed in claim 1, wherein said synthetic resin member is integrally adhered on said diaphragm piston assembly.

3. A diaphragm vacuum pump as claimed in claim 1, wherein said diaphragm piston assembly is provided thereon with a plurality of claws extending radially and inwardly and said synthetic resin member is integrally baked on said diaphragm piston assembly.

4. A diaphragm vacuum pump as claimed in claim 3, wherein said synthetic resin member is integrally molded with said diaphragm piston assembly.

* * * * *